US009884409B2

(12) United States Patent
Yang et al.

(10) Patent No.: US 9,884,409 B2
(45) Date of Patent: Feb. 6, 2018

(54) PIPE WRENCH

(71) Applicants: Chun-Wei Yang, Taichung (TW); Zhe-Ping Zhang, Taichung (TW); Qing-Jun Qian, Taichung (TW)

(72) Inventors: Chun-Wei Yang, Taichung (TW); Zhe-Ping Zhang, Taichung (TW); Qing-Jun Qian, Taichung (TW)

(73) Assignees: ZHE JIANG YIYANG TOOL MANUFACTURE CO., LTD, Zhe Jiang (CN); Chun-Wei Yang, Zhe Jiang (CN); Zhe-Ping Zhang, Zhe Jiang (CN)

( * ) Notice: Subject to any disclaimer, the term of this patent is extended or adjusted under 35 U.S.C. 154(b) by 252 days.

(21) Appl. No.: 14/996,252

(22) Filed: Jan. 15, 2016

(65) Prior Publication Data

US 2017/0203417 A1 Jul. 20, 2017

(51) Int. Cl.
*B25B 13/50* (2006.01)
*B25B 13/46* (2006.01)

(52) U.S. Cl.
CPC ..... *B25B 13/505* (2013.01); *B25B 13/462* (2013.01)

(58) Field of Classification Search
CPC ... B25B 13/505; B25B 13/462; B25B 13/463; B25B 13/461; B25B 23/0035; B25G 1/063
See application file for complete search history.

(56) References Cited

U.S. PATENT DOCUMENTS 1,968,707 A * 7/1934 Richards ..... B25B 13/505 81/117
2,142,696 A * 1/1939 Minor ..... B25B 13/505 81/117
8,925,425 B2 * 1/2015 Merhar ..... B25B 13/28 81/111

* cited by examiner

*Primary Examiner* — Robert Scruggs

(57) ABSTRACT

A pipe wrench includes a fixed jaw with alternatively located first recesses and first driving faces defined in the inner side thereof. A pivotal member is pivotably connected to the fixed jaw and a resilient member is biased between the fixed jaw and the pivotal member. The pivotal member has alternatively located third recesses and second driving faces. A hexagonal space is defined between the first and second driving faces. The end portion of the pivotal member is inserted into a second recess defined in the inner side of the fixed jaw. The object is clamped in the hexagonal space, and the pivotal member can be pivoted away from the fixed jaw. The pipe wrench is able to quickly clamp and dismounted from the object.

11 Claims, 7 Drawing Sheets

A-A

PIPE WRENCH

BACKGROUND OF THE INVENTION

1. Fields of the Invention

The present invention relates to a pipe wrench, and more particularly, to a pipe wrench with a pivotal clamping member.

2. Descriptions of Related Art

The conventional pipe wrench is disclosed in U.S. Pat. No. 4,967,612, and comprises a pivotal member which has a mounting recess defined in one side thereof, and the pivotal member is pivoted toward the fixed jaw of the wrench so as to clamp the object in the mounting recess. However, after the wrench is rotated an angle, the pivotal member has to be removed from the object, and the wrench is adjusted to another angle, the pivotal member is then pivoted toward the object again to clamp the object.

Another conventional pipe wrench is disclosed in U.S. Pat. No. 6,978,701, and comprises a pivotal member pivotably connected to the body of the wrench so as to be pivoted to clamp the object between the fixed jaw and the pivotal member. The shortcoming is the same as the wrench disclosed in U.S. Pat. No. 4,967,612. Another embodiment of the pipe wrench disclosed in U.S. Pat. No. 6,978,701 uses a link to be connected between two different segments of the pivotal member. However, the link is composed of two plates which are riveted together. The link cannot ensure the movement of the two segments is under controlled.

The present invention intends to provide a pipe wrench to eliminate the shortcomings mentioned above.

SUMMARY OF THE INVENTION

The present invention relates to a A pipe wrench includes a fixed jaw with alternatively located first recesses and first driving faces defined in the inner side thereof. A pivotal member is pivotably connected to the fixed jaw and a resilient member is biased between the fixed jaw and the pivotal member. The pivotal member has alternatively located third recesses and second driving faces. A hexagonal space is defined between the first and second driving faces. The end portion of the pivotal member is inserted into a second recess defined in the inner side of the fixed jaw. The object is clamped in the hexagonal space, and the pivotal member can be pivoted away from the fixed jaw.

The primary object of the present invention is to provide a pipe wrench which is able to quickly clamp and dismounted from the object by operating the pivotal member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 2:
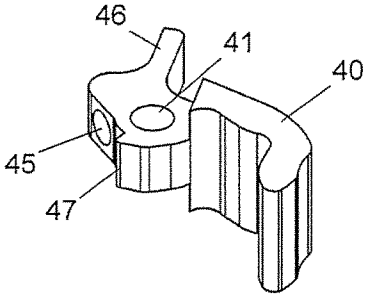
FIG. 2 is a perspective view to show the pivotal member of the pipe wrench of the present invention.
Figure 1:
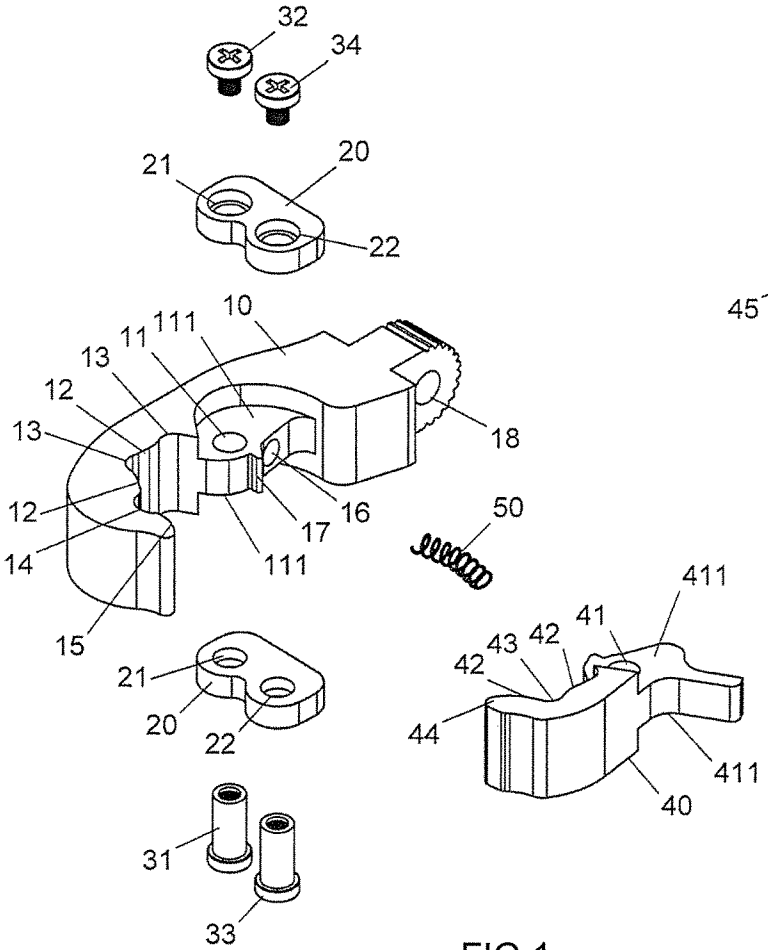
FIG. 1 is an exploded view of the pipe wrench of the present invention.
Figure 3:
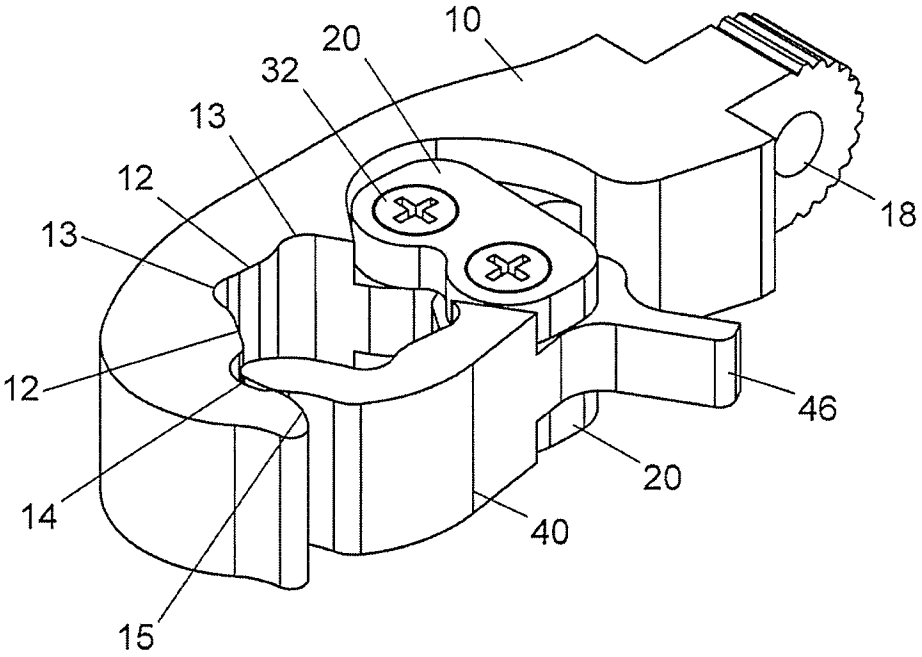
FIG. 3 is a perspective view to show the fixed jaw and the pivotal member of the pipe wrench of the present invention.
Figure 4:
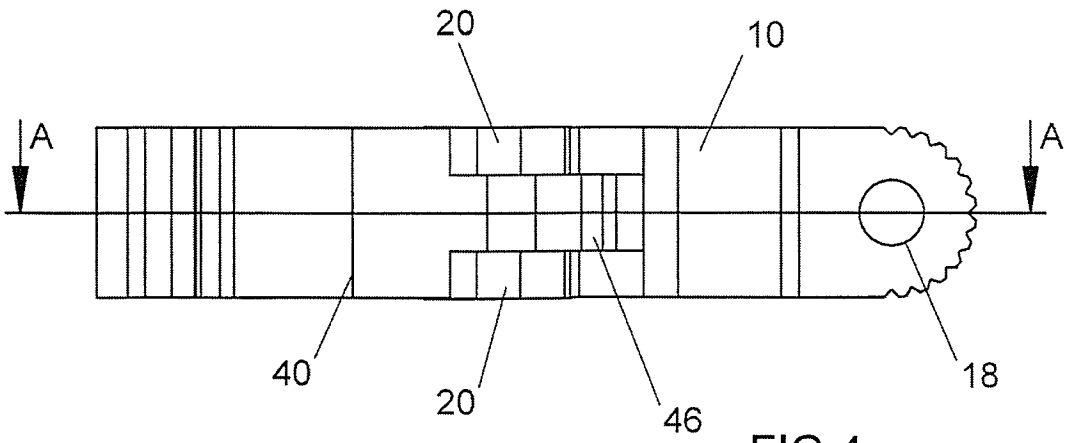
FIG. 4 is a side view to show the fixed jaw and the pivotal member of the pipe wrench of the present invention.

Referring to FIGS. 1 to 5, the pipe wrench of the present invention comprises a fixed jaw 10 having a first end and a second end which is located opposite to the first end. A pivotal end 18 is formed on the second end of the fixed jaw 10. A first pivotal portion is formed on the inner side of the fixed jaw and located close to the second end of the fixed jaw 10. The thickness of the first pivotal portion a half of the thickness of the fixed jaw 10 so as to define two first recessed areas 111 respectively defined in the top and the bottom of the first pivotal portion. A first hole 11 is defined through the first pivotal portion. Two first recesses 13 and two first driving faces 12 are formed along the inner side of the first jaw 10 and extend from the first end of the first pivotal portion, wherein the first end of the first pivotal portion is located away from the second end of the fixed jaw 10. The two first recesses 13 and the two first driving faces 12 are located alternatively to each other. A second recess 14 extends from a first end of the first driving face 12 that is located close to the first end of the fixed jaw 10. A first end portion 15 extends from a first end of the second recess 14 and is connected to the first end of the fixed jaw 10. The first driving faces 12 are a convex and curved faces, and the first recesses 13 are concaved and curved recesses. The second recess 14 is a curved recess having only one curvature. The shape of the second recess 14 is different from that of the first recesses 13. A first reception recess 16 is defined in the inner side of the pivotal portion. A first protrusion 17 extends from the inner side of the pivotal portion and is located next to the first reception recess 16.

Two connection members 20 are respectively and partially located in the first recessed areas 111 and each have a second hole 21 and a third hole 22 defined therethrough. The second and third holes 21, 22 have the same diameter. The second hole 21 of each connection member 20 communicates with the first hole 11.

A pivotal member 40 includes a first end and a second end. A second pivotal portion extends from the second end of the pivotal member 40, and the thickness of the second pivotal portion is one half of the thickness of the pivotal member 40 so as to define two second recessed areas 411 in the top and the bottom of the second pivotal portion. A fourth hole 41 is defined through the second pivotal portion. The two connection members 20 are respectively and partially located in the two second recessed areas 411. The third hole 22 of each connection member 20 communicates with the fourth hole 41. Two third recesses 43 and two second driving faces 42 are formed along the inner side of the pivotal member 40 and extend from a first end of the second pivotal portion. The first end of the second pivotal portion is located away from the second end of the pivotal member 40. The two third recesses 43 and the two second driving faces 42 are located alternatively to each other. A second end portion 44 extends from a first end of the second driving face 42 that is located close to the first end of the pivotal member 40. The second end portion 44 is connected to the first end of the pivotal member 40. The second portion 44 has a single one curvature. The second driving faces 42 have the same shape as the first driving faces 12. The third recesses 43 are concaved and curved recesses. A second reception hole 45 is defined in the inner side Of the second pivotal portion. A second protrusion 47 extends from the inner side of the pivotal portion and located next to the second reception recess 45. The second protrusion 47 is located corresponding to the first protrusion 17. A substantial hexagonal space is defined between the two first driving faces 12 and the two second driving faces 42. A resilient member 50 has two ends thereof respectively engaged with the first and second reception recesses 16, 45. The resilient member 50 provides a resilient force to insert the second end portion 44 in the second recess 14. In this embodiment, the first and second reception recesses 16, 45 each are a circular recess.

A first locking member 31 extends through the second holes 21 of the two connection members 20 and the first hole 11 to pivotably connect the connection members 20 to the first pivotal portion. A third locking member 33 extends through the two respective third holes 22 of the two connection members 20 and the fourth hole 41 of the second pivotal portion to pivotably connect the two connection members 20 to the second pivotal portion. The first locking member 31 has inner threads. A second locking member 32 has outer threads which are threadedly connected to the inner threads of the first locking member 31. The third locking member 33 has inner threads. A fourth locking member 34 has outer threads which are threadedly connected to the inner threads of the third locking member 33.

Figure 5:
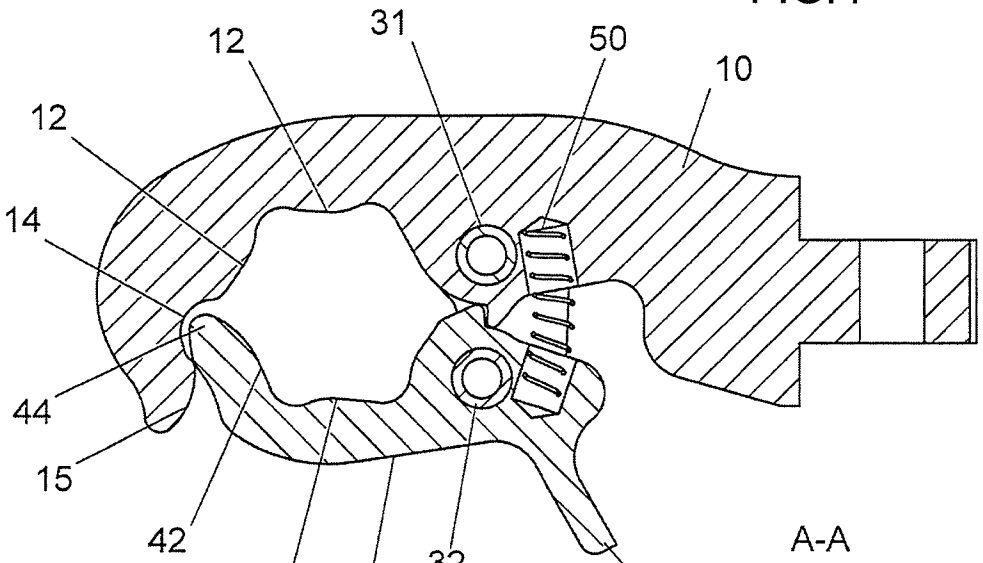
FIG. 5 is a cross sectional view, taken along line A-A of FIG. 4.

The second end portion 44 of the pivotal member 40 is moved along the inner side of the first end portion 15 and inserted in the second recess 14 of the fixed jaw 10 as shown in FIG. 5. A lever 46 extends from the second pivotal portion and away from the outer side of the second pivotal portion. The first protrusion 17 contacts the second protrusion 47.

Figure 6:
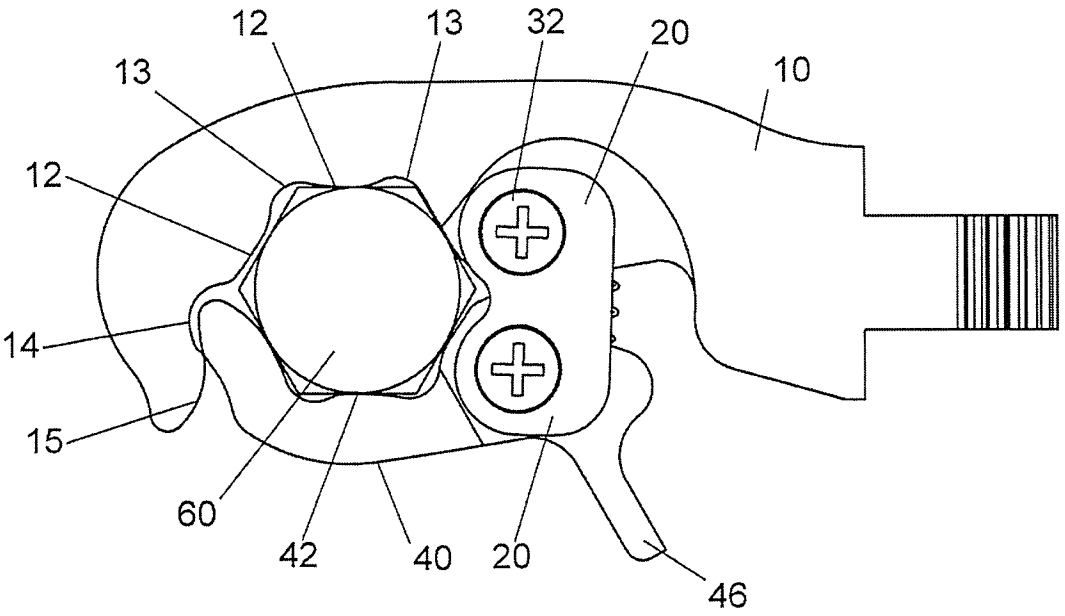
FIG. 6 is a top view to show the fixed jaw and the pivotal member of the pipe wrench of the present invention.

As shown in FIG. 6, a hexagonal object 60 can be clamped in the hexagonal space between the fixed jaw and the movable member 40. The resilient member 50 keeps the pivotal member 40 to be biased toward the fixed jaw 10. The four sides of the object 60 contact the two first driving faces 12 and the two second driving faces 42. Three of the corners of the object 60 are received in the two first recesses 13 and one of the third recesses 43. The pipe wrench can be rotated clockwise to rotate the object 60.

Figure 7:
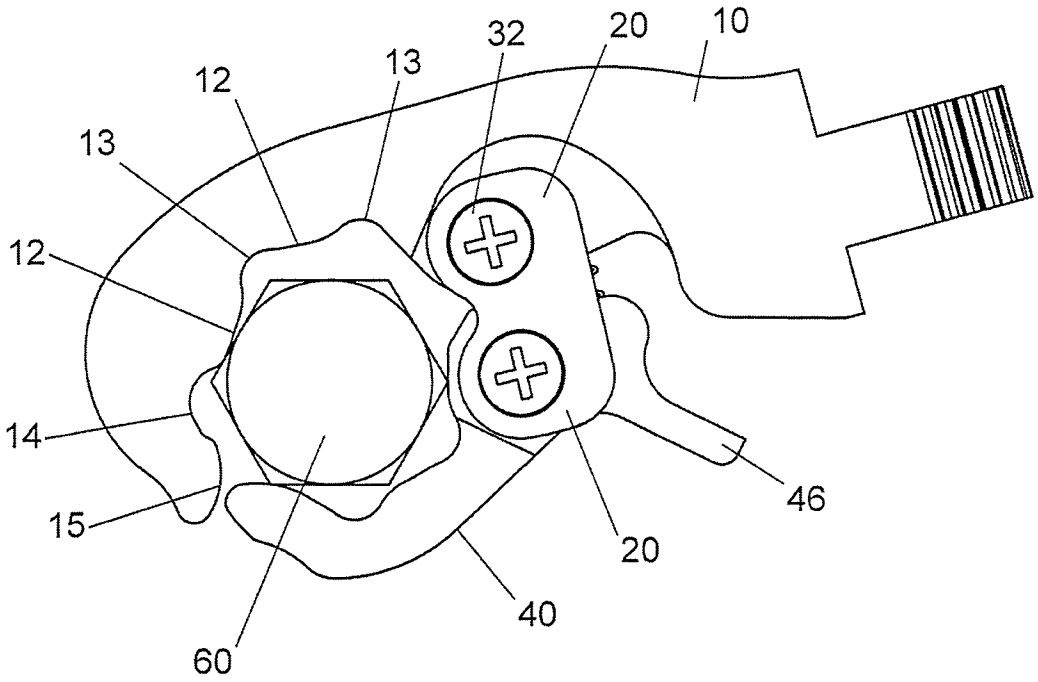
FIG. 7 shows that the pipe wrench of the present invention is rotated counter clockwise.

As shown in FIG. 7, when the pipe wrench is rotated counter clockwise, the corners of the object 60 push the second driving faces 42 to pivot the pivotal member 40 away from the fixed jaw 10, such that the pipe wrench can be freely rotated relative to the object 60. After the pipe wrench is rotated an angle, the pivotal member 40 bounces back to clamp the object 60 again.

Figure 8:
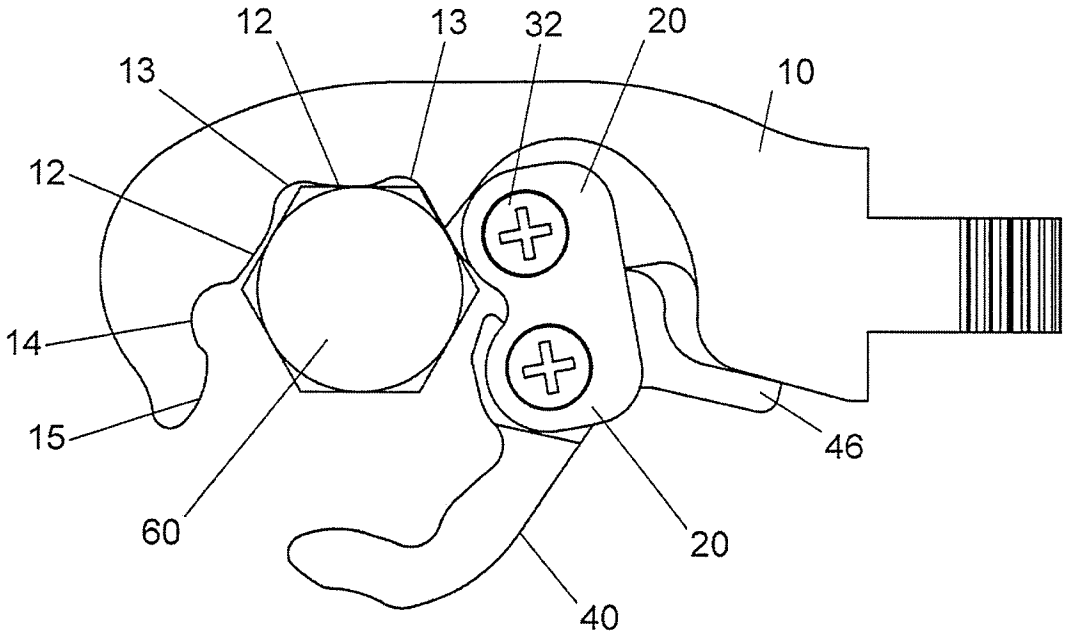
FIG. 8 shows that the pivotal member of the pipe wrench of the present invention is pivoted away from the fixed jaw.

As shown in FIG. 8, the user may pushes the lever 46 to compress the resilient member 50 and to pivot the pivotal member 40 away from the fixed jaw 10. The opening between the second end portion 44 and the first end portion 15 allows the pipe to pass, and the object 60 on the pipe is then clamped between the fixed jaw 10 and the pivotal member 40. The lever 46 is then released to allow the two first driving faces 12 and two second driving faces 42 to clamp the four sides of the object 60 as shown in FIG. 6.

Figure 9:
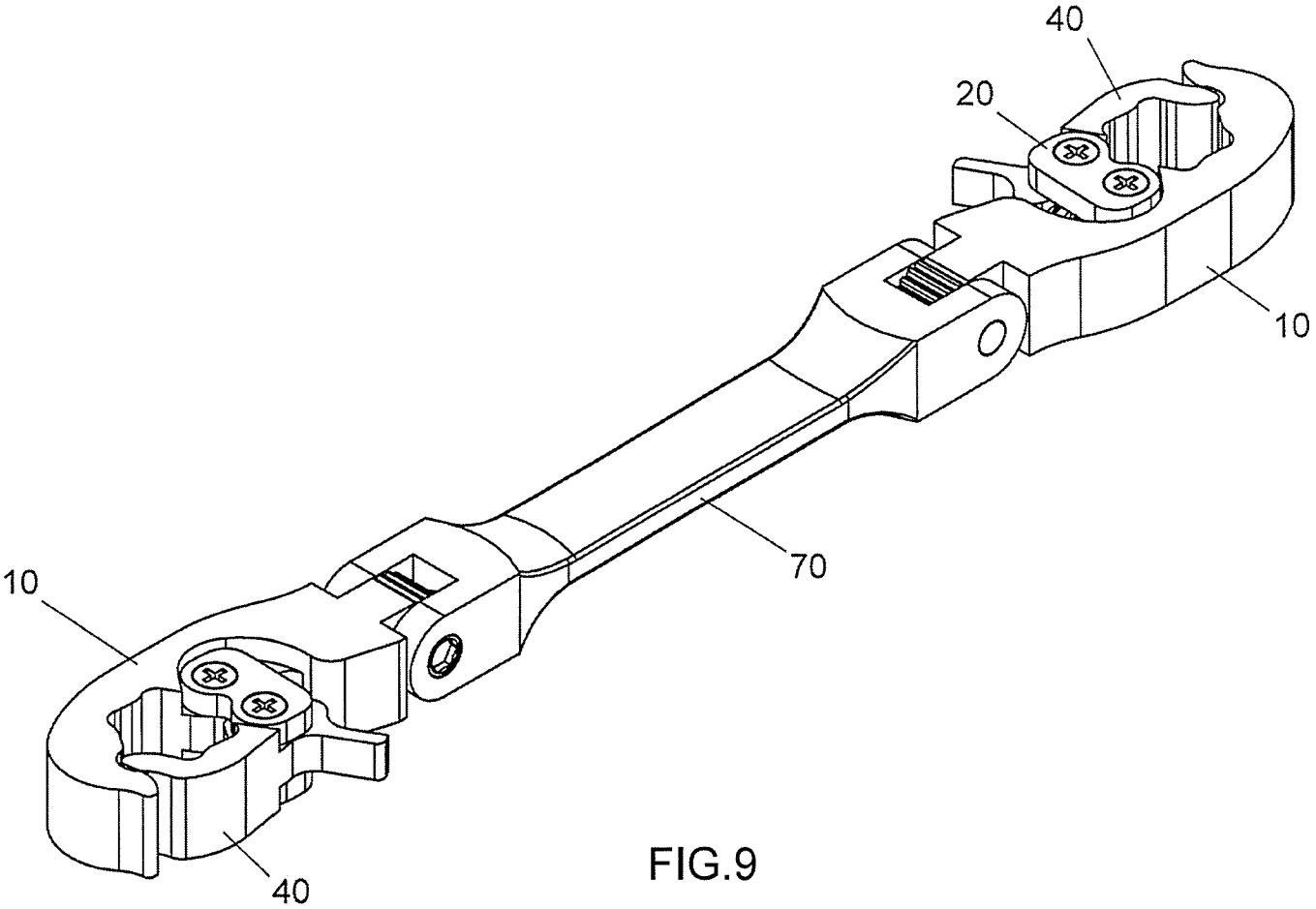
FIG. 9 shows that the pipe wrench has two function ends which include the fixed jaw and the pivotal member.

FIG. 9 shows that the pipe wrench has a handle 70 which has two ends and each of the two ends of the handle 70 is pivotably connected to the pivotal end 18 of the fixed jaw 10. Alternatively, one the two ends of the handle 70 is pivotably connected to the pivotal end 18 of the fixed jaw 10, and the other end of the handle 70 is connected with a ratchet wrench head, an open-end wrench head or a box-end wrench head.

The pipe wrench is able perform as a ratchet wrench, which means that the pipe wrench is rotated clockwise to rotate the object, and when the pipe wrench is rotated in counter clockwise, the corners of the object 60 push the second driving faces 42 to pivot the pivotal member 40 away from the fixed jaw 10, such that the pipe wrench can be freely rotated relative to the object 60. After the pipe wrench is rotated an angle, for example 60 degrees, the pivotal member 40 bounces back to clamp the object 60 again.

The user can quickly insert the pipe through the opening between the second end portion 44 and the first end portion 15 by pushes the lever 46 to compress the resilient member 50 to pivot the pivotal member 40 away from the fixed jaw 10.

The first pivotal portion is located close the second end of the fixed jaw 10, and the two connection member 20 are pivotably connected to the first and second pivotal portions. The pivotal member 40 is stably pivoted relative to the fixed jaw.

The two connection members 20 are located in the first and second recessed areas 111, 411, the two connection members 20 are in flush with the top and the bottom of the fixed jaw 10. The two connection members 20 are stably and firmly positioned in the first and second recessed areas 111, 411.

The pivotal member 40 is pivotably connected to the fixed jaw 10 by the two connection member 20, so that the pivotal member 40 is able to be opened wide from the fixed jaw 10 to allow a larger pipe to be clamped.

While we have shown and described the embodiment in accordance with the present invention, it should be clear to those skilled in the art that further embodiments may be made without departing from the scope of the present invention.

What is claimed is:

1. A pipe wrench comprising:

a fixed jaw having a first end and a second end which is located opposite to the first end, a first pivotal portion formed on an inner side of the fixed jaw and located close to the second end of the fixed jaw, a first hole defined through the first pivotal portion, a thickness of the first pivotal portion being a half of a thickness of the fixed jaw, two first recessed areas respectively defined in a top and a bottom of the first pivotal portion, two first recesses and two first driving faces formed along the inner side of the first jaw and extending from a first end of the first pivotal portion, the first end of the first pivotal portion being located away from the second end of the fixed jaw, the two first recesses and the two first driving faces located alternatively to each other, a second recess extending from a first end of the first driving face that is located close to the first end of the fixed jaw, a first end portion extending from a first end of the second recess and connected to the first end of the fixed jaw, a first reception recess defined in an inner side of the pivotal portion, a first protrusion extending from the inner side of the pivotal portion and located next to the first reception recess;

two connection members respectively and partially located in the first recessed areas and each having a second hole and a third hole defined therethrough, the second hole of each connection member communicating with the first hole;

a first locking member extending through the second holes of the two connection members and the first hole to pivotably connect the connection members to the first pivotal portion;

a pivotal member having a first end and a second end, a second pivotal portion extending from the second end of the pivotal member, a thickness of the second pivotal portion being one half of a thickness of the pivotal member so as to define two second recessed areas in a top and a bottom of the second pivotal portion, a fourth hole defined through the second pivotal portion, the two connection members respectively and partially located in the two second recessed areas, the third hole of each connection member communicating with the fourth hole, two third recesses and two second driving faces formed along an inner side of the pivotal member and extending from a first end of the second pivotal portion, the first end of the second pivotal portion being located away from the second end of the pivotal member, the two third recesses and the two second driving faces located alternatively to each other, a second end portion extending from a first end of the second driving face that is located close to the first end of the pivotal member, the second end portion connected to the first end of the pivotal member, a second reception hole defined in an inner side of the second pivotal portion, a second protrusion extending from the inner side of the pivotal portion and located next to the second reception recess, the second protrusion contacting the first protrusion, a substantial hexagonal space defined between the two first driving faces and the two second driving faces, the second end portion of the pivotal member being moved along an inner side of the first end portion and inserted in the second recess of the fixed jaw, a lever extending from the second pivotal portion and away from an outer side of the second pivotal portion;

a third locking member extending through the two respective third holes of the two connection members and the fourth hole of the second pivotal portion to pivotably connect the two connection members to the second pivotal portion, and a resilient member having two ends thereof respectively engaged with the first and second reception recesses, the resilient member providing a resilient force to insert the second end portion in the second recess.

2. The pipe wrench as claimed in claim 1, wherein the first driving faces are a convex and curved faces, the first recesses are concaved and curved recesses, the second driving faces have the same shape as the first driving faces, the third recesses are concaved and curved recesses.

3. The pipe wrench as claimed in claim 1, wherein the second recess is a curved recess having one curvature, a shape of the second recess is different from that of the first recesses.

4. The pipe wrench as claimed in claim 1, wherein the second portion has a single one curvature.

5. The pipe wrench as claimed in claim 1, wherein the first and second reception recesses each are a circular recess.

6. The pipe wrench as claimed in claim 1, wherein a pivotal end is formed on the second end of the fixed jaw.

7. The pipe wrench as claimed in claim 1, wherein the first locking member has inner threads, a second locking member has outer threads which are threadedly connected to the inner threads of the first locking member.

8. The pipe wrench as claimed in claim 1, wherein the third locking member has inner threads, a fourth locking member has outer threads which are threadedly connected to the inner threads of the third locking member.

9. The pipe wrench as claimed in claim 6, wherein a handle has two ends and each of the two ends of the handle is pivotably connected to the pivotal end of the fixed jaw.

10. The pipe wrench as claimed in claim 6, wherein a handle has two ends and one the two ends of the handle is pivotably connected to the pivotal end of the fixed jaw, the other end of the handle is connected with a ratchet wrench head, an open-end wrench head or a box-end wrench head.

11. The pipe wrench as claimed in claim 1, wherein the first and second holes having the same diameter.

* * * * *